US011434637B2

(12) United States Patent
Cochet et al.

(10) Patent No.: US 11,434,637 B2
(45) Date of Patent: Sep. 6, 2022

(54) PANEL AND SLAB DESIGNED FOR FORMING A FLOOR OR A WALL AND METHODS FOR MANUFACTURING SUCH PANELS AND SLABS

(71) Applicant: CARBON CAPTURE BUILDINGS GREENTECH, Beaurepaire (FR)

(72) Inventors: François Cochet, Barraux (FR); Raymond Nicolet, Belley (FR)

(73) Assignee: CARBON CAPTURE BUILDINGS GREENTECH, Beaurepaire (FR)

( * ) Notice: Subject to any disclaimer, the term of this patent is extended or adjusted under 35 U.S.C. 154(b) by 0 days.

(21) Appl. No.: 17/261,418

(22) PCT Filed: Jul. 17, 2019

(86) PCT No.: PCT/FR2019/051803

§ 371 (c)(1),
(2) Date: Jan. 19, 2021

(87) PCT Pub. No.: WO2020/016531

PCT Pub. Date: Jan. 23, 2020

(65) Prior Publication Data

US 2021/0262229 A1 Aug. 26, 2021

(30) Foreign Application Priority Data

Jul. 17, 2018 (FR) ..... 1856574

(51) Int. Cl.
*E04B 5/02* (2006.01)
*E04B 5/04* (2006.01)
(Continued)

(52) U.S. Cl.
CPC ..... *E04C 2/50* (2013.01); *E04B 5/04* (2013.01); *E04C 2/28* (2013.01); *E04C 2/46* (2013.01)

(58) Field of Classification Search
CPC ..... E04C 2/50; E04C 2/28; E04C 2/46; E04B 5/04; E04B 5/06; E04B 2/54; E04B 2/562; E04B 5/12; E04B 5/23; E04B 2001/743
See application file for complete search history.

(56) References Cited

U.S. PATENT DOCUMENTS 5,333,429 A * 8/1994 Cretti ..... E04C 2/205 52/309.4
7,954,291 B2 * 6/2011 Cretti ..... E04C 5/065 52/309.16

(Continued)

FOREIGN PATENT DOCUMENTS

CN 103797197 A 5/2014
EP 1 614 823 A2 1/2006

(Continued)

OTHER PUBLICATIONS

Nov. 11, 2019 Written Opinion of the International Searching Authority issued in International Patent Application No. PCT/FR2019/051803.

(Continued)

*Primary Examiner* — Gisele D Ford
(74) *Attorney, Agent, or Firm* — Oliff PLC

(57) ABSTRACT

A panel designed for forming a floor or a wall, including several beams, each beam including an armature fixed to a base, each base being made from a settable fixing material, the panel including a support having several formwork parts arranged salient from a surface receiving the support, the formwork parts forming housings to respectively receive the beams and having a bottom that is formed by the surface receiving the support, each beam being located in a respective housing where the base of the beam is fixed to the bottom of the housing, the support being formed by a single piece.

7 Claims, 1 Drawing Sheet

(51) Int. Cl.
*E04C 2/28* (2006.01)
*E04B 2/00* (2006.01)

(56) References Cited

U.S. PATENT DOCUMENTS

| | | | | |
|---|---|---|---|---|
| 8,734,691 | B1 * | 5/2014 | Boeshart | E04C 2/205 264/35 |
| 9,822,527 | B1 * | 11/2017 | Ruga | E04B 5/04 |
| 2005/0086906 | A1 * | 4/2005 | Bathon | E04C 2/296 52/782.1 |
| 2006/0251851 | A1 * | 11/2006 | Bowman | B32B 3/06 428/71 |
| 2008/0276559 | A1 * | 11/2008 | Messenger | B29C 44/12 52/506.01 |
| 2009/0126302 | A1 * | 5/2009 | Thomas | E04B 5/12 52/407.3 |
| 2009/0293419 | A1 * | 12/2009 | Gharibeh | E04B 5/026 52/782.1 |
| 2014/0030481 | A1 * | 1/2014 | Strauch | E04B 5/12 428/138 |

FOREIGN PATENT DOCUMENTS

| | | | |
|---|---|---|---|
| FR | 2 909 695 | B1 | 1/2012 |
| FR | 2 950 910 | B1 | 12/2013 |
| FR | 3 036 123 | A1 | 11/2016 |
| GB | 1 540 575 | A | 2/1979 |

OTHER PUBLICATIONS

Nov. 11, 2019 Search Report issued in International Patent Application No. PCT/FR2019/051803.

* cited by examiner

PANEL AND SLAB DESIGNED FOR FORMING A FLOOR OR A WALL AND METHODS FOR MANUFACTURING SUCH PANELS AND SLABS

BACKGROUND OF THE INVENTION

The invention relates to panels and slabs designed for forming a floor or a wall.

STATE OF THE ART

At the present time, different structures exist for erecting a construction such as a house or a building. French Patent application FR2950910 can be cited disclosing a panel for erection of a building construction comprising two parallel uprights coated in a binder comprised between two walls. But such a panel has a considerable thickness as it comprises two walls and uprights coated in a binder placed between the two walls.

French Patent application FR2909695 can also be cited disclosing a composite structure for making walls, panels, or slabs, comprising a wooden support armature coated with a binding product composed of cement or lime mixed with wood reinforcement particles. However, such a structure does not have a sufficient bearing capacity, in particular for erecting buildings comprising several storeys.

Flooring further also exists achieved by means of a method in which beams are placed spaced apart from one another, and casings, also called hollow-core slabs, are placed between two beams so that a user can move about walking on the casings. Concrete is then cast on the whole assembly to form a concrete slab. But such a method comprises several steps and is particularly lengthy to implement.

Flooring formed by means of a concrete slab in which armatures are integrated can also be cited. The slab is then placed at the location where a floor is to be made and concrete is then poured onto the slab to finalise the floor, in particular by sinking the apparent parts of the armatures in the concrete. But in case of fire, the armatures may heat and break the concrete up resulting in the floor collapsing.

A method for manufacturing a floor can further be cited in which beams are placed at the location where the floor is to be formed, the beams being secured by supports such as struts. Wooden hollow-core slabs are then placed underneath the beams. The hollow-core slabs in particular have salient parts so that the user can walk on the slabs. Concrete is then cast to form the floor. But such a method also requires several steps, including for placing the struts, which makes it long and tedious.

OBJECT OF THE INVENTION

One object of the invention consists in remedying these shortcomings, and more particularly in providing means for assembling floors or erecting walls more quickly.

Another object consists in providing means for producing a panel designed for forming a floor or a wall that is able to be prefabricated and transported from the place where it is prefabricated to the assembly site where the floor and wall are to be formed.

Another object consists in providing means for constituting fire-resistant floors. According to one feature of the invention, a panel designed for forming a floor or a wall is proposed comprising several beams, each beam comprising an armature fixed to a base, each base being made from a settable fixing material, the panel comprising a support having several formwork parts located salient from a surface receiving the support, the formwork parts forming housings to respectively receive the beams and having a bottom that is formed by the surface receiving the support, each beam being located in a respective housing where the base of the beam is fixed to the bottom of the housing.

In particular, the support is formed by a single piece.

A panel is thus provided that enables a floor or a wall to be formed more rapidly as it incorporates both a support and beams secured to one another thereby avoiding having to install several elements when forming the flooring or erecting the wall. Furthermore, the panel can be prefabricated before the floor or wall is formed by means of such a panel. Prefabrication of the panel can be performed outside the assembly site with better control of manufacturing.

The support can be made from a settable support material in which wooden parts are sunk.

Such a panel provides an efficient fire resistance as it protects the beams and prevents them from expanding in case of fire.

According to one embodiment, the support is made from, or comprises, a material comprising an organic element of vegetal origin.

Each beam can be configured so that its armature is isolated from the support so that its armature is not in direct contact with the support.

According to another feature, a slab for forming a floor is proposed comprising a panel as defined in the foregoing and a concrete coating covering the formwork parts and the housings of the panel.

The settable fixing material of each beam can be a concrete the proportions of which are identical to those of the concrete covering the formwork parts and the housings.

According to yet another feature, a method for manufacturing a panel as defined in the foregoing is proposed, comprising:

- providing a support in a single piece having several formwork parts arranged salient from a surface receiving the support, the formwork parts forming housings;
- placing an armature in each housing; and
- casting a settable fixing material in each housing so as to form a base, for each housing, fixed to the bottom of the housing to fix the armature to the support.

According to another feature, a method for manufacturing a slab as defined in the foregoing is proposed, comprising:

- providing a panel as defined in the foregoing; and
- casting a concrete coating covering the formwork parts and the housings of the panel.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which.

DETAILED DESCRIPTION

Figure 1:
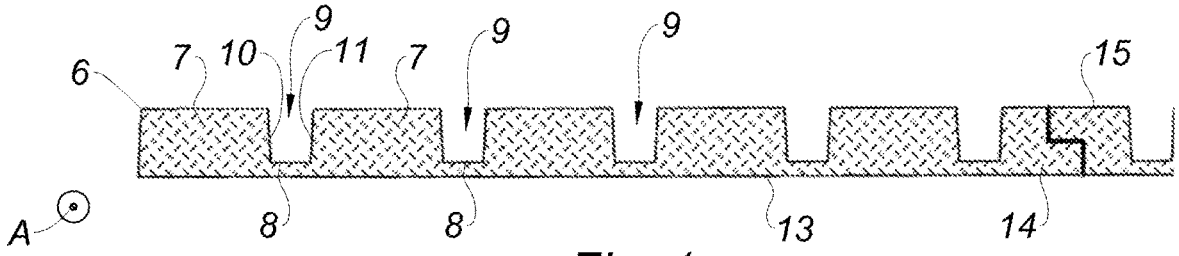
FIG. 1 schematically illustrates a cross-sectional view of an embodiment of a beam support according to the invention.
Figure 2:
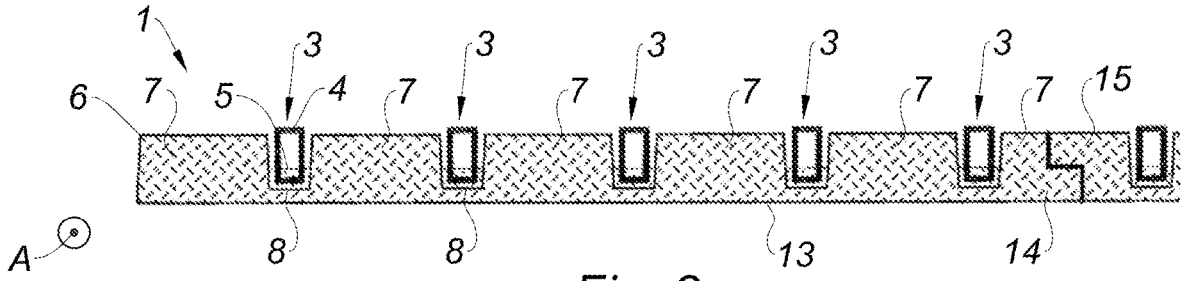
FIG. 2 schematically illustrates a cross-sectional view of an embodiment of a panel.
Figure 3:
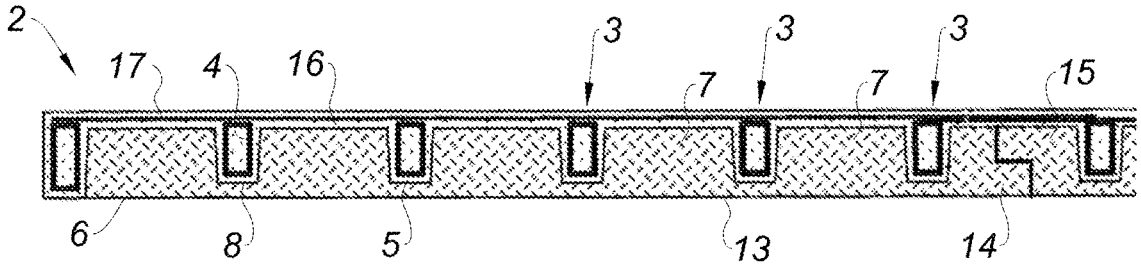
FIG. 3 schematically illustrates a cross-sectional view of an embodiment of a slab.

In FIG. 1 an embodiment of a support 6 has been represented, in FIG. 2 an embodiment of a panel 1 has been represented, and in FIG. 3 an embodiment of a slab 2 has been represented. Slab 2 is used in particular for ground coating, for example flooring, or for wall coating.

Panel 1 is designed to constitute a floor or a wall. i.e. panel 1 can be placed horizontally to constitute a floor or vertically to form a wall.

In general manner, panel 1 comprises several beams 3 and a support 6. A beam 3 is an elongate part the cross-section of which is designed to provide a flexural strength. In particular, each beam 3 comprises an armature 4 fixed to a base 5. An armature 4 is designed to reinforce the beam, and its cross-section, in conjunction with the cross-section of base 5, determines the flexural strength of beam 3. In general manner, armature 4 is made from metal. Base 5 is made from a settable fixing material, i.e. the settable material is designed to secure armature 4 to support 6. The settable fixing material can be a concrete. The concrete is a mixture of different elements such as gravel, sand, a binder and water. The binder can be a cement or lime. The proportions of the different elements of the concrete vary according to the required hardness of the concrete to be obtained. For example armature 4 has the shape of a parallelepiped or can have a triangular cross-section. Beam 3 generally extends along a longitudinal axis A of support 6. In particular, the length of a beam 3 is greater than its height and width.

Support 6 is designed in particular to support beams 3. Support 6 comprises several formwork parts 7 arranged salient from a surface 8 receiving support 6. More generally, formwork parts 7 form housings 9 shaped to respectively accommodate beams 3 to be supported. A housing 9 comprises a bottom corresponding to surface 8 receiving support 6, and side walls 10, 11 corresponding to the side walls of two formwork parts 7 situated consecutively on support 6. The two side walls 10, 11 of two consecutive formwork parts 9 are located facing one another and extend along a longitudinal axis A. In FIG. 2, it can be noted that each beam 3 is located in a housing 9. In particular, base 5 of a beam 3 is fixed to the bottom of the housing, i.e. to surface 8 receiving support 6. More particularly, support 6 is monolithic, i.e. the support is made from a single piece. A panel is thus provided that is easily transportable as beams 3 are secured by mechanical fixing to support 6. In addition, manufacturing of the flooring is better mastered as it is no longer necessary to assemble beams 3 on the site where the floor is to be laid. Advantageously, a support 6 is provided that presents a contact surface 13, opposite receiving surface 8, that is continuous. Support 6 therefore does not present any cracks and therefore no weak areas. Panel 1 therefore presents a higher flexural strength and provides a fire-resistance property due to the fact that support 6 partially protects beams 3.

According to a preferred embodiment, support 6 is made from a settable support material in which wooden parts are sunk. The wooden parts can be of different sizes. The settable support can be a binder, such as a cement, and in this case the support is made from concrete-wood. The concrete-wood material gives the flooring an enhanced fire-resistance property. Wood is in fact a better thermal insulator than the sand used in conventional concretes. Furthermore, the binder coats the wooden parts and protects them from flames. As a variant, support 6 can be made from, or comprise, a material comprising an organic element of vegetal origin. An organic element of vegetal origin can be wood, straw, cellulose, hemp or cork. An organic element contains carbon. A support 6 made from or comprising a material containing an organic element of vegetal origin therefore enables flooring to be made from carbon of natural origin, i.e. an organic element that was not produced by the chemical industry and that did not require an additional energy expenditure.

Furthermore, each beam 3 is configured so that its armature 4 is isolated from support 6 so that its armature 4 is not in direct contact with support 6. In other words, base 5 is fixed directly to the support and armature 4 is fixed directly to the base, armature 4 not being in direct contact with support 6. That is to say each armature 4 has an apparent part in the open air situated outside base 5. Panel 1 is therefore lightened as beams 3 are not completely coated. In addition, the fire-resistance property of the flooring is improved due to the fact that, when flames are in contact with contact surface 13 of the support, opposite receiving surface 8, the flames are not in direct contact with beams 3. Such a support 6 thereby limits heat propagation in case of fire. Furthermore, support 6 made from a concrete-wood material protects the beams from an excessive expansion which could occur in case of fire.

Furthermore, when support 6 is made from a concrete-wood material, base 5 is preferably made from concrete so as to secure base 5 solidly to support 6. When the concrete forming base 5 is cast, it does in fact penetrate easily into the micro-cavities of support 6.

Furthermore, a support 6 can comprise link parts 14 designed to engage in a complementary link part 15 of another support 6, as illustrated in FIGS. 1 to 3. Link parts 14 are situated on a lateral surface of support 6. Several panels 1 can thus be joined to one another to form the floor or wall.

A slab 2 has been represented in FIG. 3. Slab 2 is obtained from panel 1 described in the foregoing and comprises a concrete coating 16 covering formwork parts 7 and housings 9. The apparent parts of beams 3 are thus sunk in concrete coating 16. According to yet another advantage, the settable fixing material of each beam 3 is a concrete the proportions of which are identical to those of concrete coating 16 covering formwork parts 7 and housings 9.

The main steps of an implementation mode of a method for manufacturing a panel 1 have been represented in FIGS. 1 and 2. The method for manufacturing panel 1, as defined in the foregoing, comprises:

- providing a support 6 in a single piece having several formwork parts 7 situated salient from a surface 8 receiving support 6, formwork parts 7 forming housings 9;
- placing an armature 4 in each housing 9,
- casting a settable fixing material in each housing 9 so as to form a base 5, for each housing, fixed to the bottom of housing 9 so as to fix armature 4 to support 6.

In FIG. 3, an implementation mode of a method for manufacturing a slab 2, as defined in the foregoing, has been represented. The method comprises:

- providing a panel 1, as defined in the foregoing; and
- casting a concrete coating 16 covering formwork parts 7 and housings 9 of panel 1.

When concrete coating 16 is cast, a metal framework 17 can be added so as to provide a reinforced concrete coating 16.

The invention claimed is:

1. Slab for forming a floor, the slab including a panel and a concrete coating covering the panel, wherein the panel comprises:

- a support made from concrete in which wooden parts of different sizes are sunk, the support defining micro-cavities, the support being formed by a single piece and defining an alternation of formworks and housings, the formworks being salient from a receiving surface, the receiving surface corresponding to a bottom of the housings;

bases made of concrete and directly fixed to the support, the bases being located in the housings and the concrete filling microcavities; and armatures made of metal, the armatures being located in the housings, the bases securing the armatures to the receiving surface of the support, the armatures and the bases forming beams reinforcing the support, the armatures protruding from a top part of the formworks, the bases separating the receiving surface and the armatures;

wherein the concrete coating covers and continuously connects the several formwork parts and the housings of the panel.

2. Slab according to claim 1, wherein the support comprises an organic element of vegetal origin selected from the group consisting of straw, cellulose, hemp, and cork.

3. Slab according to claim 1, wherein each beam is configured so that the armature of each base is isolated from the support made from concrete and wooden elements and each armature is not in direct contact with the support.

4. Slab according to claim 1, wherein the concrete coating penetrates into the armatures made of metal and contacts the bases.

5. Slab according to claim 1, wherein the concrete coating forms a flat face over the armatures made of metal and the support.

6. Slab according to claim 1, wherein a settable fixing material of each beam is a concrete, wherein a proportion of the concrete being identical to a proportion of a concrete covering the several formwork parts and the housings.

7. Method for manufacturing a slab according to claim 1, comprising:

providing the support as a single-piece support made from a settable support material in which the wooden parts are sunk, the single-piece support defining microcavities, the single-piece support having the several formworks situated salient from a surface receiving of the single-piece support, the several formwork parts defining the housings;

placing one of the armatures made of metal in each housing; and casting a concrete layer in each housing so as to form the bases fixed to a bottom of the housing to fix the armatures to the single-piece support, the concrete layer filling microcavities, and casting the concrete coating covering the several formwork parts and the housings of the single-piece support, the concrete coating continuously connecting the armatures and the bases.

* * * * *